US006827621B1

(12) United States Patent
Enomoto et al.

(10) Patent No.: US 6,827,621 B1
(45) Date of Patent: Dec. 7, 2004

(54) METHOD AND APPARATUS FOR MANUFACTURING FLAT IMAGE DISPLAY DEVICE

(75) Inventors: Takashi Enomoto, Saitama-ken (JP); Takashi Nishimura, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/926,399

(22) PCT Filed: Apr. 24, 2000

(86) PCT No.: PCT/JP00/02658

§ 371 (c)(1),
(2), (4) Date: Jan. 14, 2002

(87) PCT Pub. No.: WO00/67282

PCT Pub. Date: Nov. 9, 2000

(30) Foreign Application Priority Data

Apr. 28, 1999 (JP) ..... 11/122220

(51) Int. Cl.[7] ..... H01J 9/00

(52) U.S. Cl. ..... 445/24; 445/51; 445/59; 445/66

(58) Field of Search ..... 445/24, 25, 50, 445/51, 53, 59, 60, 66, 6

(56) References Cited

U.S. PATENT DOCUMENTS 3,732,359 A * 5/1973 Chen ..... 348/812
5,054,421 A * 10/1991 Ito et al. ..... 118/723 HC
5,587,720 A * 12/1996 Fukuta et al. ..... 345/75.2
5,614,785 A * 3/1997 Wallace et al. ..... 313/496
5,849,093 A 12/1998 Andrae
5,876,260 A * 3/1999 Pepi et al. ..... 445/25
6,302,758 B1 * 10/2001 Watkins et al. ..... 445/59
6,409,564 B1 * 6/2002 Browning et al. ..... 445/24
6,517,403 B1 * 2/2003 Cooper et al. ..... 445/25
2002/0142698 A1 * 10/2002 Kosugi et al. ..... 445/25

* cited by examiner

*Primary Examiner*—Nimeshkumar D. Patel
*Assistant Examiner*—German Colón
(74) *Attorney, Agent, or Firm*—Oblon, Spivak, McClelland, Maier & Neustadt, P.C.

(57) ABSTRACT

The manufacturing method of a flat panel display comprises facing a faceplate, which has a phosphor screen, to a rear plate, which has an electron emitting element, with a predetermined gap, and joining. At least one of a rear plate (20) and a faceplate (10) is accommodated in an electron beam cleaning chamber (42, 46), and, an electron beam (53) is irradiated onto the rear plate (20) or the faceplate (10) from an electron beam generator (52), which is disposed in the electron beam cleaning chamber (42, 46), in a vacuum atmosphere. Thereby, a surface adsorbed gas is sufficiently degassed. Thus, by sufficiently degassing the surface adsorbed gas in the display, the inside of a vacuum vessel as an envelope can be maintained in a high vacuum state.

11 Claims, 4 Drawing Sheets

METHOD AND APPARATUS FOR MANUFACTURING FLAT IMAGE DISPLAY DEVICE

This application is a 371 application of PCT/JP00/02658 filed Apr. 24, 2000.

TECHNICAL FIELD

The present invention relates to a manufacturing method and manufacturing equipment of a flat panel display, which has an electron emitting element, such as a field emission cold cathode or the like.

BACKGROUND

Recently, by making use of highly developed semiconductor machining techniques, a field emission cold cathode is under active development, and an application of the field emission cold cathode to a flat panel (planar type) display is under progress. A flat panel display having a filed emission type electron-emitting element is self-emitting type, different from a liquid crystal display, and a backlight is unnecessary. Accordingly, there are various advantages that low power consumption may be realized, a broader field angle may be obtained, and a rapid response speed may be obtained.

As the flat panel display like this, one that has a structure, such as shown in FIGS. 7A and 7B, is known. FIG. 7B is a sectional view showing, in enlargement, a portion surrounded by a circle in FIG. 7A.

In this image display, a silicon dioxide film 103, which has a large number of cavities 102, is formed on a Si substrate 101 as a rear plate, and, a gate electrode 104, consisting of molybdenum or niobium, is formed on the silicon dioxide film 103. A field emission type electron emitting element 105, consisting of cone-like molybdenum or the like, is formed on the Si substrate 101 inside the cavities 102.

A transparent substrate (face plate) 106, consisting of a glass substrate or the like, is disposed in parallel with the Si substrate 101 like this, which has a large number of electron emitting elements 105, so as to face the Si substrate 101 with a predetermined spacing. Therefrom, a vacuum envelope 107 is configured. A phosphor screen 108 is formed on a surface facing the electron emitting elements 105 of the transparent substrate 106. In addition, in order to sustain an atmospheric pressure on the Si substrate 101 and the transparent substrate 106, supporting members 109 are disposed between these substrates.

In the aforementioned flat panel display, electron beams, emitted from a large number of electron emitting elements 105, are illuminated on the phosphor screen 108; the phosphor screen 108 is excited to emit light; and, thereby, an image is formed. In the image display like this, the electron emitting elements 105 may be formed in a small size of micrometer-order, and the spacing between the Si substrate 101 and the transparent substrate 106 may be formed in a size of millimeter-order. As a result, in the flat panel display, higher resolution, lighter weight, and thinner thickness may be attained, in comparison with cathode ray tubes (CRT) which have been used for television sets or computer displays.

In the flat panel display having the aforementioned structure, a vacuum degree inside the device is necessary to be maintained in the range of, for instance, $10^{-7}$ to $10^{-8}$ Torr. In order to attain this, in the existing exhausting process, gas adsorbed on an inside surface of the image display is degassed in the shortest time, by applying baking treatment, in which the image display is heated up to approximately 350° C. However, by such an exhausting method, the gas adsorbed on the surface cannot be sufficiently degassed.

On the other hand, in the existing CRTs and so on, a getter disposed inside the device is activated after sealing, and, the gas released from an inner wall, during operation, is absorbed by the getter, thereby a desired degree of vacuum is maintained. This technique for obtaining a high vacuum and maintaining a A degree of vacuum by means of gettering material is under way in applying in the flat panel displays.

In the flat panel display in which the field emission electron emitting elements are used, while a volume of a vacuum vessel (vacuum envelope), which is determined by the rear and face plates and the supporting frame disposed at the sides thereof, may be largely reduced in comparison with that of the ordinary CRT, an area of an inner surface, from which the gas is released, is not so much reduced. As a result, when the surface adsorption gas is released to an extent equivalent with that of the CRT, an increase in pressure in the vacuum vessel becomes remarkably large. Accordingly, in the flat panel display, role of the gettering material becomes very important. However, a place, where a conductive gettering film is formed, has been limited, from a viewpoint of inhibiting short circuits of interconnections.

To such problems, it is proposed to dispose the gettering material at a position, other than an image display region, of the vacuum vessel, and to form the gettering film, in a periphery portion that does not affect on the image display region (Japanese Patent Laid-Open Application No. 5-151916 JP-A, Japanese Patent Laid-Open Application No. 4-289640 JP-A, and so on). However, according to such methods, the gas generated in the image display region may not be effectively absorbed by the gettering film, which is formed in the periphery portion. As a result, there has been a problem that it is difficult to maintain a high vacuum in the vacuum envelope, over a long time period.

By the above reasons, it is under study to dispose the gettering film in the image display region. In Japanese Patent Laid-open Application No. 9-82245 JP-A, for instance, the following is disclosed. That is, a gettering material, consisting of titanium (Ti), zirconium (Zr), or alloy thereof, is sputtered on a metal back layer, which is formed on a phosphor film in a faceplate of a flat panel display; or the metal back hd layer is constituted of the aforementioned gettering material; or the above gettering material is disposed on a portion, other than the electron emitting element, of the rear plate, in the image display region.

However, in the flat panel display, which is disclosed in the above Japanese Patent Laid-Open Application No. 9-82245 JP-A, since the gettering material is formed according to an ordinary panel formation process, a surface of the gettering material is naturally oxidized. In the gettering material, since activity of the surface thereof is very important, the surface-oxidized gettering material could not obtain a sufficient gas absorption effect.

Therefore, in the above publication, it is disclosed that, after a space between the faceplate and the rear plate is hermetically sealed through supporting frames, and a vacuum envelope is formed, the gettering material is activated by means of electron beam irradiation and so on. However, according to such method, the gettering material may not be effectively activated. In particular, in case the gettering material is activated, after the vacuum envelope is formed, since gas components, such as oxygen or the like, which are released due to the activation, are adsorbed by the electron emitting elements or other members, electron emissivity or the like may be deteriorated.

The present invention is carried out to overcome these problems. The object of the present invention is to provide a method for manufacturing a flat panel display, according to which, gas adsorbed on an inside surface of the device in the course of manufacturing process, may be sufficiently degassed, and, thereby, a high vacuum state may be maintained inside the vacuum vessel (the vacuum envelope); and manufacturing equipment of the flat panel displays.

DISCLOSURE OF THE INVENTION

A first aspect of the present invention is a manufacturing method of a flat panel display. The manufacturing method of a flat panel display comprises joining a substrate, which has an electron emitting element, and a faceplate, which has a phosphor screen, so that the electron emitting element and the phosphor screen face to each other with a gap and irradiating electrons onto at least one of the substrate and the faceplate, in a vacuum atmosphere.

More specifically, the irradiating of electrons has accommodating at least one of the substrate and the faceplate in a treatment vessel, and irradiating the electrons onto at least one of the substrate and the faceplate accommodated in the treatment vessel from one or more electron sources disposed therein.

In the present manufacturing method of the flat panel display, the electrons are preferably irradiated in a vacuum atmosphere of which degree of vacuum is maintained at $10^{-3}$ Torr or less in the irradiating of electrons. In addition, in the electron irradiating process, it is preferable to irradiate the electrons onto at least one of the substrate and the faceplate, while being heated. In heating, at least one of the substrate and the faceplate is preferably heated to a temperature from 200 to 400° C. Furthermore, after the electrons are irradiated, an irradiated object is preferably cooled to a temperature of 100° C. or less. After the irradiating of electrons, the substrate and the faceplate may be joined through a supporting frame in a vacuum atmosphere. The supporting frame may be irradiated with the electrons.

A second aspect of the present invention is a manufacturing equipment of a flat panel display. The manufacturing equipment of a flat panel display comprises a treatment vessel in which at least one of a substrate, which has an electron emitting element, and a faceplate, which has a phosphor screen, is accommodated, transferring means for sending at least one of the substrate and the faceplate in and out of the treatment vessel, exhausting means for evacuating the inside of the treatment vessel to a vacuum atmosphere, irradiating means for irradiating an electron beam onto at least one of the substrate and the faceplate, which are accommodated in the treatment vessel, and joining means for joining the substrate and the faceplate, at least one of which is irradiated with the electron beam, while arranging so as for the electron emitting element and the phosphor screen to face to each other with a gap.

The manufacturing equipment of a flat panel display of the present invention may further include means for heating at least one of the substrate and the faceplate, which are accommodated in the treatment vessel.

In general, the irradiation of the electron beam onto a solid material may detach gas adsorbed on a solid surface. Accordingly, by accommodating the substrate, which has the electron emitting elements, or the faceplate, in the treatment vessel, the inside of which is evacuated to be a vacuum atmosphere, and by irradiating the electron beam onto the substrate or the faceplate, from an electron source disposed in the treatment vessel, an entire surface of the substrate and of the faceplate may undergoes thorough electron beam cleaning, and, thereby, surface adsorbed gas may be sufficiently released. By performing such electron beam irradiation, the inside of the vacuum vessel, which constitutes the envelope of the flat panel display, may be made capable of maintaining a high vacuum state, for instance, a degree of vacuum of from $10^{-7}$ to $10^{-8}$ Torr.

EMBODIMENTS

In the following, embodiments of the present invention are described. Incidentally, the present invention is not restricted to the following embodiments.

First, a manufacturing method of a flat panel display of the present invention will be explained, with reference to FIG. 1.

Figure 1A:
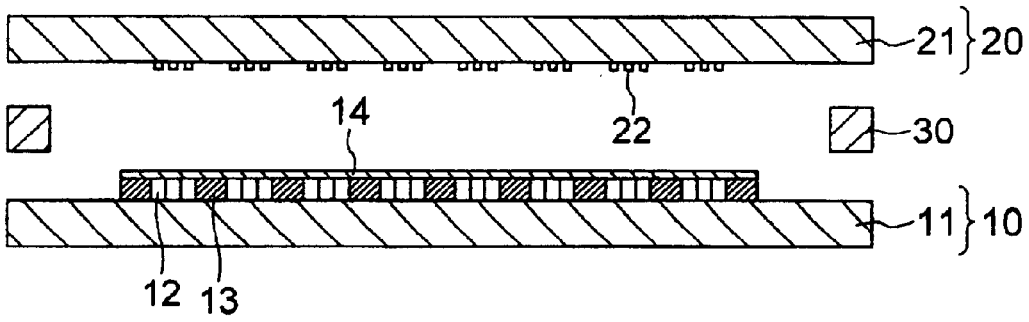
FIGS. 1A and 1B are sectional views showing schematically manufacturing processes according to one embodiment, in a manufacturing method of a flat panel display of the present invention.

As shown in FIG. 1A, a faceplate 10, a rear plate 20, and support frames 30 are prepared according to an ordinary method.

The faceplate 10 has a transparent substrate, such as a glass substrate 11 or the like, and a phosphor layer 12 which is formed on the transparent substrate. In a color image display, the phosphor layer 12 has a red emitting phosphor layer, a green emitting phosphor layer, and a blue emitting phosphor layer, all of which are formed corresponding to pixels. In addition, a light absorbing layer 13, consisting of black conductive material, is disposed so as to separate between them. The phosphor layer 12, which emits in each of red color, green color, and blue color, and the light absorbing layer 13, which separates them, are repeatedly formed in turn in a horizontal direction. A phosphor screen is constituted of the phosphor layer 12 and the light absorbing layer 13, and the phosphor screen is an image display region.

The light absorbing layer 13 is called black stripe, black matrix, and so on, according to its pattern. In the black stripe type phosphor screen, phosphor stripes of red, green, and blue colors are formed in turn, and, the light absorbing layer 13, which is formed in stripes, separates between the phosphor stripes. In the black matrix type phosphor screen, phosphor dots of red, green, and blue colors are formed in lattice, and the light absorbing layer 13 separates between them. To arrange the phosphor dots, various kinds of methods may be applied.

A metal back layer 14 is formed on the phosphor layer 12. The metal back layer 14, which is constituted of a conductive thin film, such as Al film or the like, reflects light proceeding toward a rear plate 20, which has an electron emitting source, of light generated by the phosphor layer 12, and thereby, may improve brightness. Furthermore, the metal back layer 14 endows conductivity the image display region of the faceplate 10, thereby, may suppress charges from accumulating, and plays the role of an anode electrode with respect to the electron emitting source of the rear plate 20. Still furthermore, the metal back layer 14 has a function that inhibits ions of residual gas generated in the vacuum vessel (envelope) by the electron beam from the electron emitting source, from damaging the phosphor layer 12.

Slurry method and printing method may be applied, as the method for forming the phosphor layer 12 and the light absorbing layer 13 on the glass substrate 11. After the phosphor layer 12 and the light absorbing layer 13 are formed on the glass substrate 11, respectively, further thereon, a conductive thin film, consisting of Al film or the like, is formed by means of vapor deposition or sputtering, and thereby the metal back layer 14 is formed. The thickness of the Al film is, though dependent on an anode voltage or the like, preferable to be 2500 nm or less.

The rear plate 20 has a substrate 21, such as an insulating substrate, such as glass substrate, ceramic substrate or a silicon (Si) substrate and a large number of electron emitting elements 22 on the substrate 21. These electron emitting elements 22 comprise, for instance, field emission cold cathodes (emitter) or surface conduction electron emitting elements. Wiring (not shown) is disposed on a surface of the rear plate 20, on which electron emitting elements 22 of are formed. That is, the number of electron emitting elements 22 are formed in matrix, corresponding to phosphors of individual pixels, and the wiring (X-Y wiring), which intersect with each other, are formed to drive the matrix-like electron emitting elements 22, line by line.

The supporting frames 30 hermetically seal a space between the faceplate 10 and the rear plate 20. The supporting frames are joined to the faceplate 10 and the rear plate 20, by means of frit glass or indium (In) or alloy thereof. These form the vacuum vessel, as the envelope described below. The supporting frames 30 are provided with signal input terminals and signal line selection terminals (not shown). These terminals correspond to the cross wiring (X-Y wiring) of the rear plate 20.

Figure 1B:
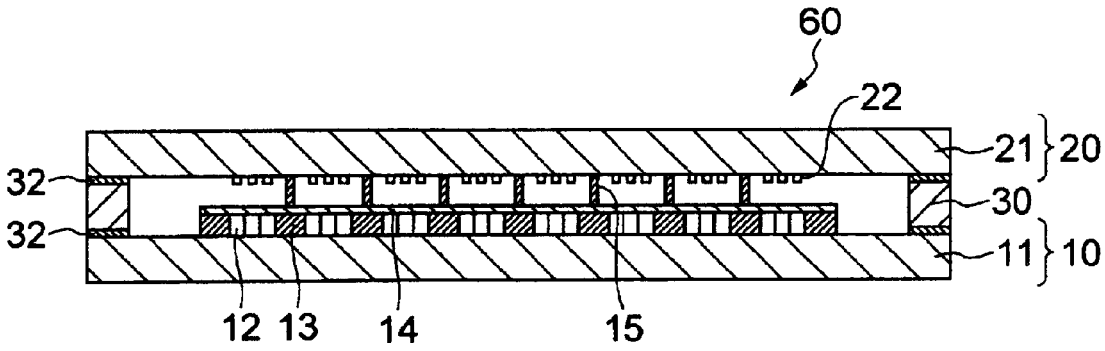

When the flat panel display is large in size, bending may be caused, since the device is formed in a thin plane table. In order to avoid the bending and increase mechanical strength against the atmospheric pressure, reinforcement plates (atmospheric pressure sustaining member) 15 may be appropriately disposed, as shown in FIG. 1B, in conformity with an intended strength.

The above-mentioned faceplate 10, rear plate 20 and supporting frames 30 are prepared, respectively. Thereafter, the cleaning of the substrate by means of the electron beam irradiation, the vacuum deposition of the getter film, and the formation of the vacuum vessel as the envelope (joining the supporting frames 30 to the faceplate 10 and rear plate 20) are performed, while maintaining the vacuum atmosphere. For such sequence of the process, vacuum treatment equipment 40, as shown, in FIG. 2, may be used.

Figure 2:
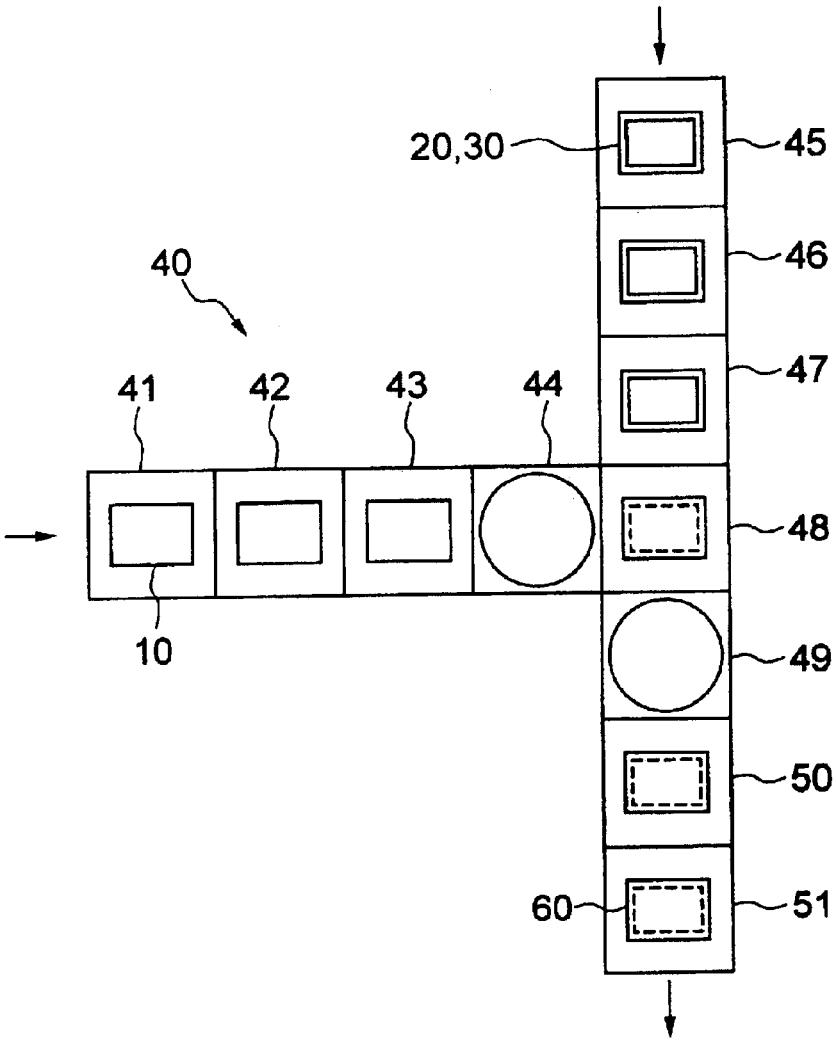
FIG. 2 is a diagram showing roughly one example of a configuration of vacuum treatment equipment, which is used in the manufacturing method of the present invention.

The vacuum treatment equipment 40 shown in FIG. 2 includes a loading chamber 41 of the faceplate 10, a baking and electron beam cleaning chamber 42, a cooling chamber 43, a vapor deposition chamber of the getter film 44, a loading chamber 45 of the rear plate 20 and the supporting frames 30, a baking and electron beam cleaning chamber 46, a cooling chamber 47, an assembly chamber 48 of the faceplate 10 and the rear plate 20, a heat treatment chamber 49 for joining the supporting frames 30 to the faceplate 10, a cooling chamber 50, and an unloading chamber 51.

Each of the aforementioned treatment chambers (treatment vessels) is a vacuum treatment chamber in which the processing in the vacuum atmosphere may be applied, and, all chambers are evacuated, when the image displays are manufactured. The degree of vacuum, is preferable to be, for instance, $1\times10^{-3}$ Torr or less, furthermore to be $1\times10^{-5}$ Torr or less. The individual treatment chambers are connected by gate valves or the like. In addition, the vacuum treatment equipment 40 includes means for sending in and out the faceplate 10 and the rear plate 20, to be treated, and for transferring them between the Individual treatment chambers (not shown), and vacuum exhausting means (exhausting device or the like) for exhausting the inside of the individual treatment chambers (not shown).

Figure 3:
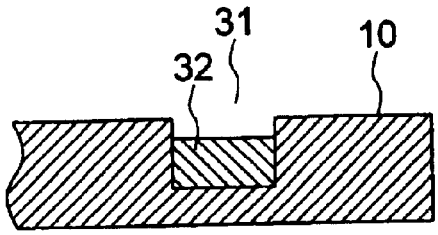
FIG. 3 is a sectional view showing, in enlargement, one example of a structure of a faceplate end portion, in the manufacturing method of the flat panel display of the present invention.

The faceplate 10, which has undergone up to the formation of the metal back layer 14, is first set inside the loading chamber 41. At end portions of the faceplate 10, grooves 31 are formed beforehand, as shown in FIG. 3, and, joining material 32, such as In or alloy thereof, may be disposed in the grooves 31, so as to hermetically seal between the faceplate 10 and the supporting frames 30. Then, after the atmosphere in the loading chamber 41 is evacuated to be a vacuum atmosphere, the faceplate 10 is sent in the baking and electron beam cleaning chamber 42.

In the baking and electron beam cleaning chamber 42, the faceplate 10 is heated up to a temperature in the range from 300 to 400° C., for instance, and the faceplate 10 is degassed. When the joining material 32, is previously disposed in the grooves 31 at the end portions of the faceplate 10, the joining material 32 may drop out of the grooves 31 after melting due to heating. In order to keep the joining material 32 from dropping, the faceplate 10 is preferably disposed at a lower portion in the baking and electron beam cleaning chamber 42, with the grooves 31 directed upward.

Figure 4:
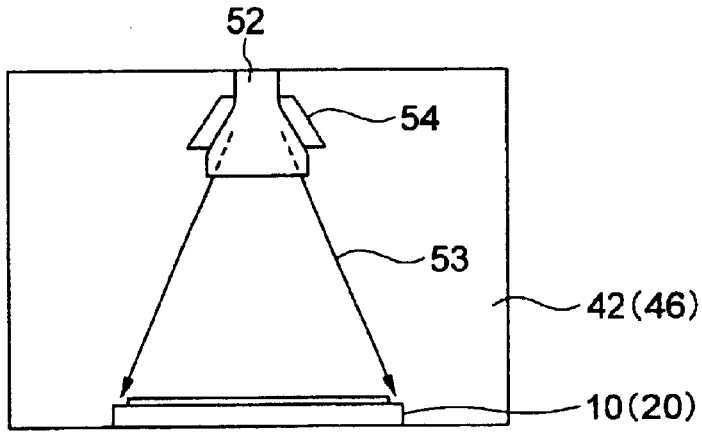
FIG. 4 is a diagram showing schematically a first example of an electron beam cleaning process, in the manufacturing method of the flat panel display of the present invention.

Simultaneously with the aforementioned baking, as shown in FIG. 4, for instance, an electron beam 53 is irradiated onto a surface having the phosphor screen of the faceplate 10, in the vacuum atmosphere, from an electron beam generator 52, which is disposed at an upper portion of the baking and electron beam cleaning chamber 42. The degree of vacuum, at the irradiation of the electron beam 53, is preferable to be $1\times10^{-3}$ Torr or less, furthermore preferable to be $1\times10^{-5}$ Torr or less. The electron beam 53 is deflected and scanned by a deflection yoke 54 attached to an outside of the electron beam generator 52. Thereby, an entire surface of the faceplate 10 may be irradiated by the electron beam, and cleansed.

Figure 5:
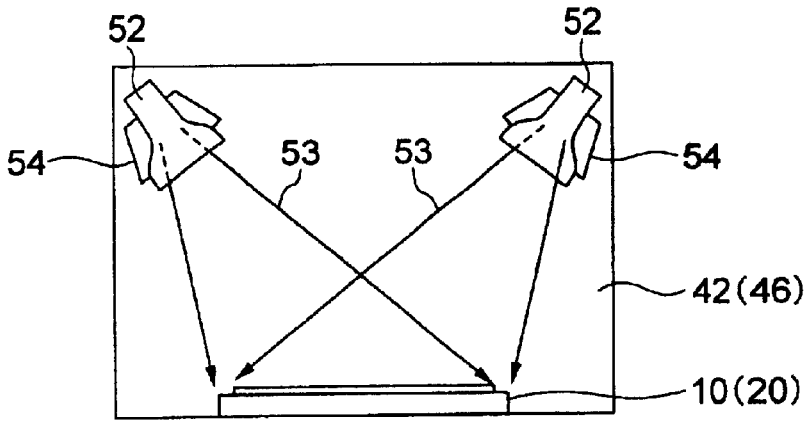
FIG. 5 is a diagram showing schematically a second example of an electron beam cleaning process, in the manufacturing method of the flat panel display of the present invention.
Figure 6:
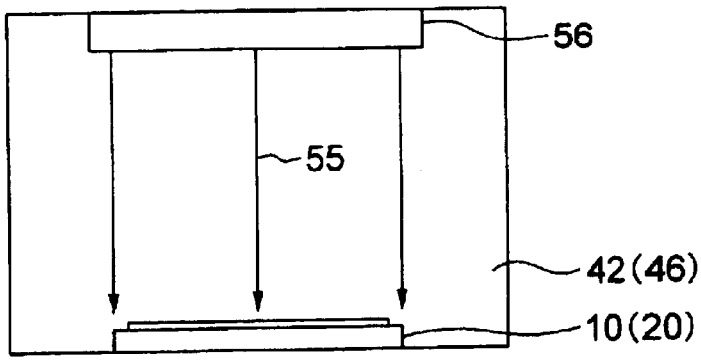
FIG. 6 is a diagram showing schematically a third example of an electron beam cleaning process, in the manufacturing method of the flat panel display of the present invention.
Figure 7A:
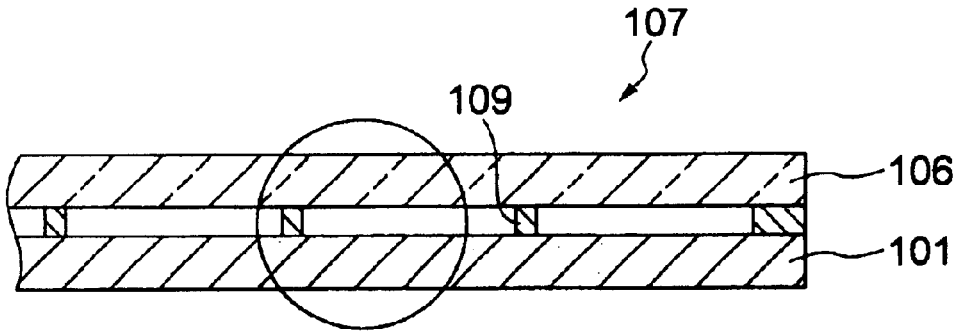
FIGS. 7A and 7B are sectional views showing a structure of an essential portion of the flat panel display.
Figure 7B:
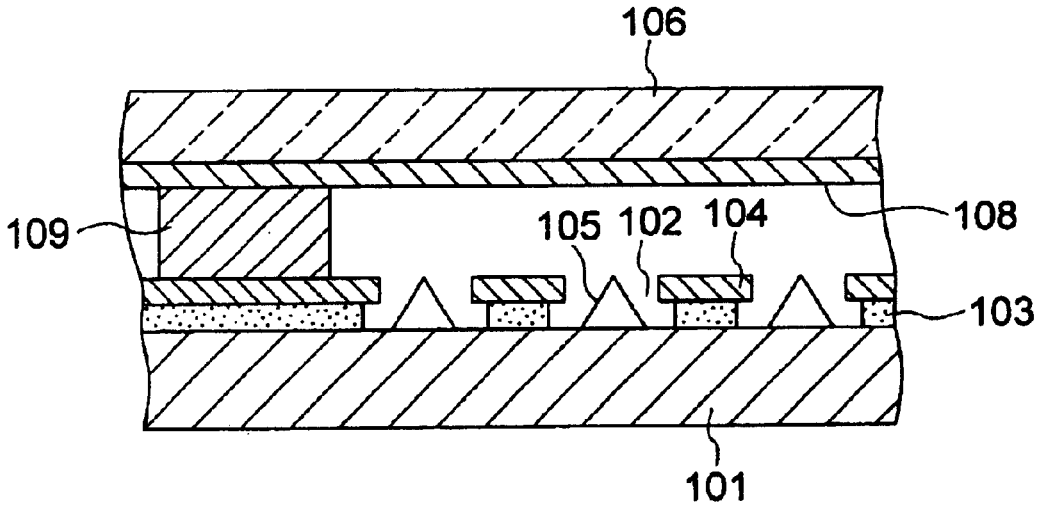

The number of the electron beam generator 52, a shape thereof, and an electron beam generating method thereof are not particularly restricted to ones shown in FIG. 4. For instance, a plurality of electron beam generators 52 (two sets in FIG. 5) may be disposed and, the electron beams 53 may be alternately or simultaneously irradiated from the plurality of electron beam generators 52. Furthermore, an electron beam generator 56, which generates parallel beams 55, may be used, as shown in FIG. 6.

The faceplate 10 to which the heating and the electron beam cleaning have been applied, is transferred to the cooling chamber 43, and, cooled down to a temperature of, for instance, 100° C. or less (80 to 100° C., for instance). Then, the cooled faceplate 10 is transferred into the vacuum deposition chamber 44 of the getter film. In the vacuum deposition chamber 44, on the outside of, for instance, the phosphor layer 12, a film of active barium (Ba) (not shown) is vacuum deposited as the getter film. Thereafter, the faceplate 10 is transferred to the assembly chamber 48.

Due to easiness of the process, the rear plate 20, in which the electron emitting sources are disposed on the substrate, and the supporting frames 30 are preferably integrated in one body, before being set in the loading chamber 45. Then, after the atmosphere in the loading chamber 45 is evacuated to be a vacuum atmosphere, the rear plate 20 and the supporting frames 30 (alternatively, an integrated assembly) are transferred from the loading chamber 45 to the baking and electron beam cleaning chamber 46.

In the baking and electron beam cleaning chamber 46, similarly as the aforementioned faceplate 10, the rear plate 20 and the supporting frames 30 are heated to a temperature in the range from 300 to 400° C. to degas, the rear plate 20. At the same time with this baking, the electron beam is irradiated from the electron beam generator, for instance, the electron beam generators 52 and 56, shown in FIGS. 4 through 6, which are attached to an upper portion of the baking and electron beam cleaning chamber 46. The electron beams are deflected and scanned by means of the deflection yokes 54, which are attached to the outside of the electron beam generators 52 and 56, and an entire surface of the rear plate 20 may be cleansed by the electron beam.

Then, after the baking and the electron beam cleaning, the rear plate 20 and the supporting frames 30 are transferred to the cooling chamber 47, and cooled to a temperature of 100° C. or less (80 to 100° C., for instance). The cooled rear plate 20 and supporting frames 30 are transferred to the assembly chamber 48, similarly as the aforementioned faceplate 10.

The faceplate 10, the rear plate 20, and the supporting frames 30 are assembled (positioning) in the assembly chamber 48. When assembling, the reinforcement plates may be disposed between the faceplate 10 and the rear plate 20, if necessary.

Then, the assembled one is transferred into the heat treatment chamber 49. In the heat treatment chamber 49, heat treatment is performed in the vacuum atmosphere, at a temperature according to the joining material 32; the faceplate 10 and rear plate 20 are pressed through the supporting frames 30 and joined. If necessary, the electron emitting source is activated beforehand. Since each process up to the joining is performed in the vacuum atmosphere, a surface of the getter film (Ba film) in the vapor deposition chamber 44 is suppressed from being contaminated by oxygen or carbon; an active state is maintained.)

In case that In or alloy thereof is used as the joining material 32, the joining is performed under heating at approximately 100° C. At the depression during the joining, ultrasound may be preferably applied to the joining portion or in the neighborhood thereof, so as to make more sufficient joining. When the joining material 32, such as In or alloy thereof, is previously disposed in the grooves 31 at the end portions of the faceplate 10, In or the alloy 31 thereof may drop from the grooves 32, after melting by the heating during the joining. In order to inhibit this from occurring, the faceplate 10 is preferably disposed at a lower portion of the heat treatment chamber 49, with the grooves 31 directed upward, and, the rear plate 20, to which the supporting frames 30 are fixed, is preferably disposed from an upper portion thereof and joined.

It is generally said that In or alloy thereof is insufficient in joining strength. However, in the flat panel display of the present invention, since the gap between the faceplate 10 and the rear plate 20 is maintained in a vacuum, a sufficient joining strength may be obtained due to the addition of the atmospheric pressure, even when In or alloy thereof only is used as the joining material 32. In order to increase furthermore the strength at the joining portion, the joining portion may be strengthened by means of epoxy resin or the like.

Thus, a vacuum vessel, as the envelope, is formed with the faceplate 10, the rear plate 20, and the supporting frames 30. That is, the flat panel display 60, shown in FIG. 1B, is manufactured, by hermetically sealing the space between the faceplate 10 and the rear plate 20 by means of the supporting frames 30. Thereafter, the flat panel display 60 is cooled to room temperature in the cooling chamber 50, and, taken out of the unloading chamber 51.

The vacuum treatment equipment 40, which is used to manufacture the flat panel display 60, may be equipment in which individual configurations from the loading chamber 41 to the unloading chamber 51 are combined. Whenever the vacuum atmosphere of the inside of the vacuum treatment equipment may be maintained, the configuration thereof is not particularly restricted. Furthermore, in the aforementioned embodiment, the faceplate 10 and the rear plate 20 are separately electron beam cleansed. However, both held with a predetermined spacing distanced from a tool may simultaneously undergo the electron beam cleaning.

According to the flat panel display 60, which is obtained by the aforementioned manufacturing method and manufacturing equipment, a high vacuum state of $10^{-7}$ to $10^{-8}$ Torr, which is necessary for obtaining sufficient electron emissivity, may be attained at an initial stage, with good reproducibility. This is because, in addition to the individual steps being performed in the vacuum atmosphere, the entire surfaces of the faceplate 10 and the rear plate 20 are thoroughly electron beam cleansed, and the gas adsorbed on the surfaces thereof are sufficiently degassed. That is, since the gas is hardly evolved during operation of the flat panel display 60, excellent emission properties may be obtained over a long period.

Furthermore, in the aforementioned manufacturing process of the flat panel display 60 of the present invention, since hermetic sealing process is performed in the vacuum atmosphere, after manufacture, a process for exhausting the inside of the device becomes unnecessary, contrary to the manufacture of the conventional flat panel display. Accordingly, an exhausting configuration (tubing for evacuation, for instance) or an exhauster, which is indispensable in the conventional device, becomes unnecessary. Furthermore, since such tubing for evacuation becomes unnecessary, exhaust conductance becomes larger, and, an exhausting efficiency of the flat panel display becomes excellent.

The flat panel display 60 as mentioned above is used in TV display, based on, for instance, TV signals according to NTSC system. At this time, a signal input terminal and a line selection terminal and furthermore a high voltage terminal (all of them are not shown) are connected with an external electric circuit. In case conductive In or In alloy is used for the joining material 32, the joining material 32 may be used also as the terminals.

To each of the terminals, scanning signals are inputted to sequentially drive, line by line, electron emitting sources disposed in the flat panel display 60, that is, electron emitting elements 22, which is interconnected in matrix of M rows×N columns, and, furthermore, modulation signals, which control an output electron beam of the electron emitting elements 22 of the selected one line, are inputted. At the high voltage terminal, an accelerating voltage is inputted to endow the electron beam, which is emitted from the electron emitting elements 22, sufficient energy to excite the phosphor.

In the flat panel display 60 configured thus, a voltage is applied to each of the electron emitting elements 22 through the terminal, and thereby electron emission is caused. In addition, a high voltage is applied through a high voltage terminal to the metal back layer 14, and thereby the electron beam is accelerated. The accelerated electrons impinge on the phosphor layer 12 and cause the phosphor layer to emit, and thereby an image is displayed.

The flat panel display obtained according to the present invention may be used as various kinds of image displays, such all as, for instance, displays of TV receivers or computer terminals.

INDUSTRIAL APPLICABILITY

As explained above, according to the manufacturing method and the manufacturing equipment of the flat panel displays of the present invention, the surface adsorbed gas may be sufficiently degassed, due to a thorough electron beam cleaning of the entire surface of the faceplate or the rear plate. Accordingly, the inside of the flat panel display may be maintained in high vacuum state, for a long time period.

What is claimed is:

1. A method of manufacturing method of a flat panel display, including joining a substrate having, an electron emitting element and a faceplate having a phosphor screen, so that the electron emitting element and the phosphor screen face each other with a gap, comprising:

treating the faceplate, comprising (a) irradiating of an electron beam onto the faceplate accommodated in a treatment vessel, while heating the faceplate in a vacuum atmosphere, and (b) forming a getter film on the faceplate, onto which the electron beam is irradiated, by means of vacuum deposition;

treating the substrate, comprising irradiating the electron beam onto the substrate accommodated in a treatment vessel, while heating the substrate in a vacuum atmosphere;

assembling the substrate and the faceplate, which have been irradiated with the electron beam; and heating and joining the assembled substrate and faceplate in a vacuum atmosphere.

2. The method of claim 1, wherein the faceplate and the substrate are accommodated in a same treatment vessel, both held with a predetermined spacing, and the electron beam is irradiated onto the faceplate and the substrate alternately or simultaneously from two or more electron sources.

3. The method of claim 1, wherein the electron beam is irradiated alternately or simultaneously from two or more electron sources which are disposed in the treatment vessel in at least one of the irradiating of the electron beam onto the faceplate and the irradiating of the electron beam onto the substrate.

4. The method of claim 1, wherein the electron beam emitted from the electron source is irradiated, while being deflected, in at least one of the irradiating of the electron beam onto the faceplate and the irradiating of the electron beam onto the substrate.

5. The method of claim 1, wherein the electron beam emitted from a planar type of the electron source is irradiated in at least one of the irradiating of the electron beam onto the faceplate and the irradiating of the electron beam onto the substrate.

6. The method of claim 1, wherein the electron beam is irradiated in a vacuum atmosphere of which degree of vacuum is maintained at $10^{-3}$ Torr or less in at least one of the irradiating of the electron beam onto the faceplate and the irradiating of the electron beam onto the substrate.

7. The method of claim 1, wherein at least one of the substrate and the faceplate is heated at a temperature in a range from 200 to 400° C. in at least one of the irradiating of electron beam onto the faceplate and the irradiating of the electron beam onto the substrate.

8. The method of claim 1, wherein, after the electron beam is irradiated onto at least one of the substrate and the faceplate, the irradiated at least one of the substrate and the faceplate is cooled to a temperature of 100° C. or less.

9. The method of claim 1, wherein the faceplate and the substrate are joined through a supporting frame in the vacuum atmosphere, after the electron beam is irradiated onto the faceplate and the substrate, in the heating and joining step.

10. The method of claim 9, wherein the supporting frame is irradiated with the electron beam in the irradiating of the electron beam onto the substrate.

11. A manufacturing equipment of a flat panel display, in which a substrate having an electron emitting element and a faceplate having a phosphor screen are joined so that the electron emitting element and the phosphor screen face to each other with a gap, comprising:

a first baking and cleaning chamber;

a second baking and cleaning chamber;

a vapor deposition chamber in which a getter film is formed;

an assembly chamber;

a heat treatment chamber; and transferring means for transferring and sending at least one of the substrate and the faceplate into and out of the chambers, wherein:

the first baking and cleaning chamber, comprises a treatment vessel in which the substrate and the is accommodated;

exhausting means for evacuating an inside of the treatment vessel to a vacuum atmosphere;

irradiating means for irradiating an electron beam onto the substrate, which is accommodated in the treatment vessel; and means for heating the substrate and the faceplate, which is accommodated in the treatment vessel, the second banking and cleaning chamber comprises a treatment vessel in which the faceplate is accommodated;

exhausting means for evacuating an inside of the treatment vessel to a vacuum atmosphere;

irradiating means for irradiating an electron beam onto the faceplate, which is accommodated in the treatment vessel; and means for heating the faceplate, which is accommodated in the treatment vessel, the vapor deposition chamber comprises treatment vessel in which the faceplate, onto which the electron beam is irradiated, is accommodated; and means for forming the getter film on the faceplate by means of the vacuum deposition; and the assembly chamber comprising, comprises a treatment vessel in which the substrate and the faceplate, which are irradiated with the electron beam, both held with a predetermined spacing, are accommodated; and exhausting means for evacuating the inside of the treatment vessel to a vacuum atmosphere, and the heat treatment chamber comprises a treatment vessel in which the assembled substrate and faceplate is accommodated; and means for heating and joining the substrate and the faceplate.

* * * * *